United States Patent [19]

Tsuboi

[11] Patent Number: 4,674,455

[45] Date of Patent: Jun. 23, 1987

[54] SPLIT CRANKCASE FOR V-TYPE ENGINE

[75] Inventor: Masaharu Tsuboi, Saitama, Japan

[73] Assignee: Honda Giken Kogyo Kabushiki Kaisha, Tokyo, Japan

[21] Appl. No.: 768,912

[22] Filed: Aug. 21, 1985

Related U.S. Application Data

[63] Continuation of Ser. No. 340,780, Jan. 19, 1982, abandoned.

[30] Foreign Application Priority Data

Jan. 27, 1981 [JP] Japan ..... 56-10355

[51] Int. Cl.[4] ..... F02F 7/00

[52] U.S. Cl. ..... 123/195 R; 123/195 C; 123/DIG. 6

[58] Field of Search ..... 123/DIG. 6–DIG. 8, 123/195 R, 195 C

[56] References Cited

U.S. PATENT DOCUMENTS

| | | | |
|---|---|---|---|
| 870,001 | 11/1907 | Way | 123/195 R |
| 1,286,435 | 12/1918 | Slate | 123/195 R |
| 3,304,134 | 2/1967 | Allen | 123/195 R |
| 3,561,416 | 2/1971 | Kiekhaefer | 123/DIG. 7 |
| 4,198,947 | 4/1980 | Rassey | 123/DIG. 6 |
| 4,245,595 | 1/1981 | Abe | 123/195 C |

FOREIGN PATENT DOCUMENTS

| | | | |
|---|---|---|---|
| 0515493 | 1/1931 | Fed. Rep. of Germany | 123/DIG. 7 |
| 726125 | 10/1942 | Fed. Rep. of Germany . | |
| 755623 | 11/1952 | Fed. Rep. of Germany . | |
| 1273269 | 7/1968 | Fed. Rep. of Germany . | |
| 691852 | 10/1930 | France | 123/195 R |
| 1009977 | 11/1965 | United Kingdom . | |
| 1328196 | 8/1973 | United Kingdom . | |

*Primary Examiner*—Craig R. Feinberg

*Attorney, Agent, or Firm*—Lyon & Lyon

[57] ABSTRACT

An internal combustion V-type engine has a crankcase which is split horizontally on a plane containing the axis of the crankshaft. Relatively thin stationary webs in the upper and lower crankcase halves are aligned and each pair receives a plurality of fastening elements such as cap screws which extend through the lower half of the crankcase across the horizontal joint and into the upper half of the crankcase. These pairs of webs are placed at intervals along the length of the crankshaft to support it for rotation.

3 Claims, 4 Drawing Figures

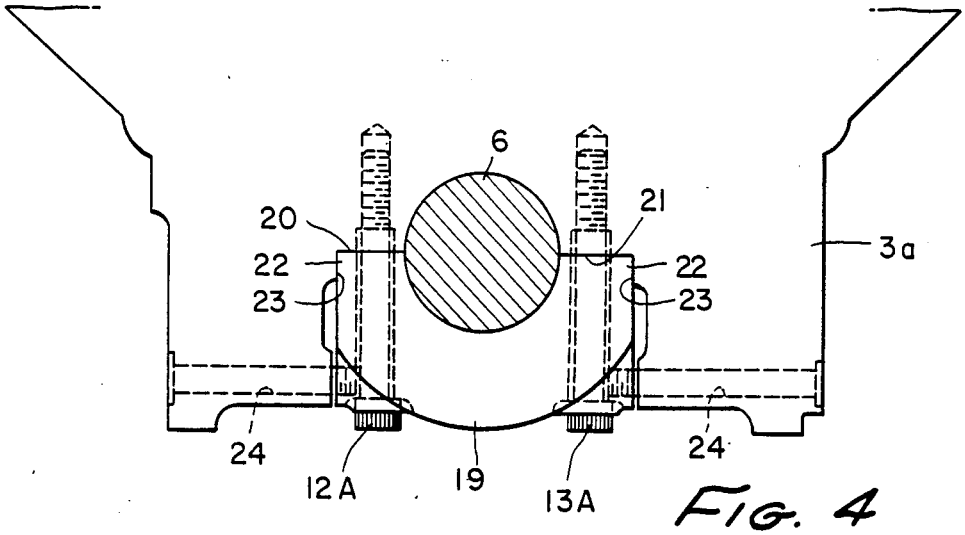
FIG. 4
PRIOR ART
FIG. 3
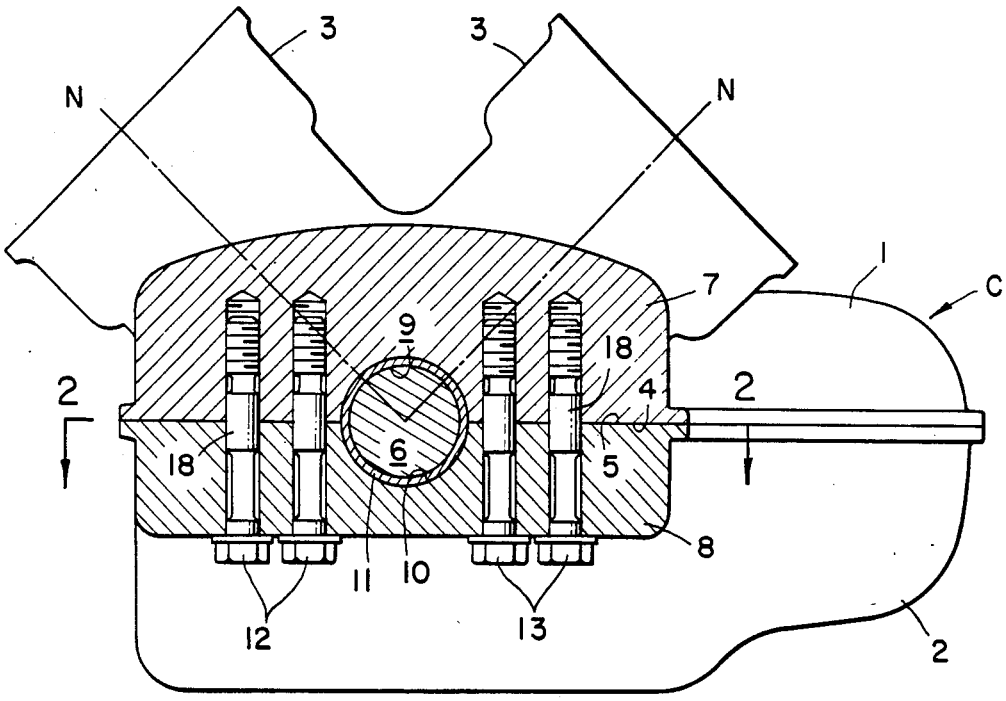

SPLIT CRANKCASE FOR V-TYPE ENGINE

This application is a contination of application Ser. No. 340,780, filed 1-19-82 now abandoned.

This invention relates to V-type internal combustion engines having cylinders extending at an angle from the crankshaft, the center lines of the cylinders defining the shape of the letter "V".

The crankshaft of V-type internal combustion engines is provided with one or more "throws" which are driven by connecting rods pivoted to pistons operating in the cylinders. With such construction, there is a large component of forces acting on the crankshaft which occur in a plane which is ordinarily horizontal and which is symmetrically positioned between the center lines of the cylinders. The crankshaft thus receives lateral forces of considerable magnitude.

In V-type engines of conventional design, such as for example, as disclosed in the Johnson et al U.S. Pat. No. 3,117,498 for "Internal Combustion Engine", the crankshaft is held in position between the engine block and bearing blocks bolted to the engine block. These bearing blocks are placed at intervals along the length of the crankshaft and are removable for purposes of installation and disassembly of the crankshaft with respect to the other parts of the engine. Such conventional construction has many drawbacks. Manufacture of parts of the engine block adjacent the crankshaft location is difficult because of the precision techniques required, and also because too many parts are needed which also increases the cost.

The principal object of this invention is to provide an engine requiring no special manufacturing process on the divided faces of the parts which hold the crankshaft in place.

In accordance with this invention, the crankcase is formed in two parts; the upper portion and the lower portion have flat mating surfaces on a plane passing through the crankshaft axis and symmetrical with respect to the angle of inclination of the cylinders. Relatively thin webs are provided in the upper crankcase and in the lower crankcase, pairs of webs being aligned at intervals along the length of the crankshaft. The webs are split along the horizontal joint between the upper and lower portions of the crankcase. Pairs of fasteners such as cap screws are mounted on each side of the crankshaft and extend through the lower webs across the horizontal joint and into the upper webs.

Other and more detailed objects and advantages will appear hereinafter.

IN THE DRAWINGS

FIG. 3 is a sectional elevation taken substantially on the lines 3—3 as shown on FIG. 2.

FIG. 4 is an end view partly in section showing an example of the prior art.

Figure 1:
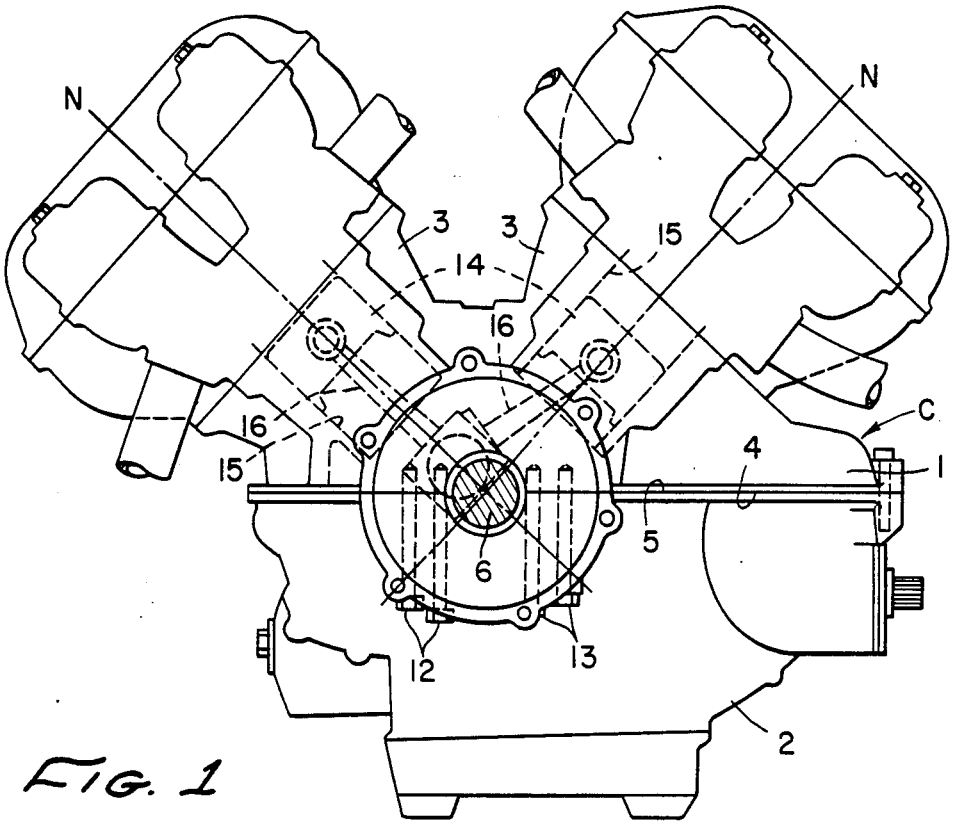
FIG. 1 is a front elevation showing a preferred embodiment of this invention..
Figure 2:
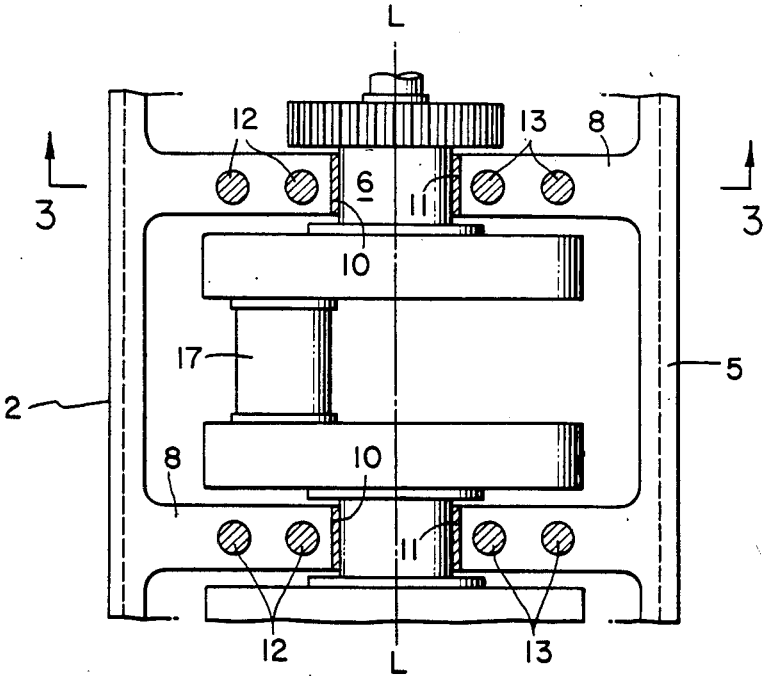
FIG. 2 is a plan view, partly broken away, taken substantially on the lines 2—2 as shown on FIG. 3.

Referring to the drawings, the crankcase C of a V-type multi-cylinder internal combustion enqine is divided to form an upper crankcase 1 and a lower crankcase 2 having horizontal mating faces 4 and 5. The V-shape is defined between the center lines N—N of the cylinders which are contained within the V-shaped engine block 3. As shown in FIG. 1, pistons 14 reciprocate in the cylinder bores 15 and are connected by connecting rods 16 to the crankthrow 17 (FIG. 2). The axis L—L of the crankshaft 6 is shown in FIG. 2.

The upper bearing wall 7 in the upper crankcase 1 and the lower bearing wall 8 in the lower crankcase 2 cooperate with the bearing faces 9 and 10 on the bearings 11 to hold the crankshaft 6 in proper position for free rotation.

Because of the angularity of the lines N—N with respect to the horizontal plane of the joint 4, 5, the forces delivered by the connecting rods 16 to the crankthrow 17 have large horizontal complements tending to cause relative axial sliding movement along the joint surfaces of 4, 5. To resist such forces pairs of cap screws 12 and 13 in transverse alignment fix the upper bearing wall 7 with respect to the lower bearing wall 8 and prevent relative movement between them. The cap screws have central portions 18 which form a tight fit within their respective openings through the mating surfaces 4 and 5.

At least two cap screws 12 and 13 are required on each side of the crankshaft 6, but a greater number may be employed if desired. The use of a plurality of cap screws on each side of the crankshaft means that a thinner wall 7, 8 can be employed as compared to the thicker walls which would be required if only one (larger) cap screw were to be employed on each side of the crankshaft 6. The result is that the overall length of the engine can be reduced, and this is a very desirable feature.

FIG. 4 shows a prior art device in which the crankshaft 6 is supported between the engine block 3-A and the bearing block 19. This bearing block 19 has a horizontal surface 20 which mates with the horizontal surface 21 on the block 3A. Lateral shoulders 22 on the bearing block 19 are carefully machined for snug or interference fit with the vertical surfaces 23 on the engine block. One cap screw 12A extends through the bearing block 19 on one side of the crankshaft 6 and one cap screw 13A extends through the bearing block 19 on the other side of the crankshaft 6. Additional threaded elements are employed in the aligned transverse openings 24 for reception of threaded elements, not shown, which contact the cap screws 12A and 11A for greater rigidity. The prior art device shown in FIG. 4 is more expensive to construct and is inferior in performance.

Having fully described my invention, it is to be understood that I am not to be limited to the details herein set forth, but that my invention is of the full scope of the appended claims.

I claim:

1. In a V-type internal combustion engine having angularly positioned cylinders radiating from a crankshaft, the improvement comprising, in combination:

a split crankcase having an upper portion and a lower portion with mating surfaces in a plane containing the axis of the crankshaft, said upper and lower portions being arranged such that the angularly positioned cylinders are contained within said upper portion, a plurality of axially spaced relatively thin stationary webs within said crankcase extending transversely to the crankshaft, each web having an upper portion integral with the upper portion of the crankcase and having a lower portion integral with the lower portion of the crankcase, the webs cooperating to support the crankshaft, at least two fastening elements positioned through each said relatively thin stationary web to each side of the crankshaft for fixedly securing the lower web portions with respect to the upper web portions, the fastening elements for each web all lying in the same plane normal to the axis of the crankshaft, each said fastening element having an enlarged central portion extending across and substantially equally on opposite sides of said mating surfaces which tightly fits each of said upper and lower portions of said crankcase.

2. The combination set forth in claim 1 in which said fastening elements are cap screws.

3. The combination set forth in claim 1 wherein said fastener elements are threaded at a first end.

* * * * *